US006945311B2

(12) United States Patent
Hulek

(10) Patent No.: US 6,945,311 B2
(45) Date of Patent: Sep. 20, 2005

(54) METHOD FOR THE VERTICAL CONTINUOUS CASTING OF A STEEL STRIP

(76) Inventor: Anton Hulek, Goglerfeldgasse 15, A 4040 Linz (AT)

( * ) Notice: Subject to any disclaimer, the term of this patent is extended or adjusted under 35 U.S.C. 154(b) by 0 days.

(21) Appl. No.: 10/477,154

(22) PCT Filed: May 7, 2002

(86) PCT No.: PCT/AT02/00139

§ 371 (c)(1),
(2), (4) Date: May 17, 2004

(87) PCT Pub. No.: WO02/090018

PCT Pub. Date: Nov. 14, 2002

(65) Prior Publication Data

US 2004/0188057 A1 Sep. 30, 2004

(30) Foreign Application Priority Data

May 7, 2001 (AT) ..... A 723/2001

(51) Int. Cl.[7] ..... B22D 11/00

(52) U.S. Cl. ..... 164/476; 164/417; 164/413; 164/454; 164/442; 164/430; 164/479

(58) Field of Search ..... 164/476, 417, 164/443, 454, 442, 430, 479, 413

(56) References Cited

U.S. PATENT DOCUMENTS 4,951,734 A 8/1990 Höffken et al.
4,962,808 A 10/1990 Höffken
5,339,887 A 8/1994 Flemming et al.
5,577,548 A * 11/1996 Hohenbichler et al. ..... 164/452
5,730,206 A * 3/1998 Gerding ..... 164/430

FOREIGN PATENT DOCUMENTS

AT WO/0050189 8/2000
DE 4135214 A1 3/1993
EP 0329639 8/1989

* cited by examiner

*Primary Examiner*—Kevin Kerns
*Assistant Examiner*—I.-H. Lin
(74) *Attorney, Agent, or Firm*—Collard & Roe, P.C.

(57) ABSTRACT

In a method for vertical continuous casting of a steel band, a strand (11) of a parallelogram-like cross section is cast at first in a revolving chill-mold (2) and is thereafter transferred from said initial cross section with completely solidified longitudinal edges (10) and liquid core into a band (1) with plane-parallel cross section, this occurring in such a way that an already solidified shell (9) of the strand (11) which becomes increasingly thicker by cooling is increasingly compressed in the casting direction in a forming device (4) without upsetting deformation of the completely solidified longitudinal edges (10). In order to provide advantageous conditions it is proposed that after the compression into a band (1) the strand (11) with a still liquid core (16) is guided during the complete solidification of the core merely in a forming gap with a constant width corresponding to the thickness of the completely solidified longitudinal edges (10) and is calibrated in this process.

7 Claims, 3 Drawing Sheets

METHOD FOR THE VERTICAL CONTINUOUS CASTING OF A STEEL STRIP

CROSS REFERENCE TO RELATED APPLICATIONS

Applicant claims priority under 35 U.S.C. §119 of AUSTRIAN Application No. A723/2001 filed on May 7, 2001. Applicant also claims priority under 35 U.S.C. §365 of PCT/AT02/00139 filed on May 7, 2002. The international application under PCT article 21(2) was not published in English.

FIELD OF THE INVENTION

The invention relates to a method for vertical continuous casting of a steel band, with a strand of a parallelogram-like cross section being cast at first in a revolving chill-mold and being thereafter transferred from said initial cross section with completely solidified longitudinal edges and liquid core into a band with plane-parallel cross section, this occurring in such a way that an already solidified shell of the strand which becomes increasingly thicker by cooling is increasingly compressed in the casting direction in a forming device without upsetting deformation of the completely solidified longitudinal edges.

DESCRIPTION OF THE PRIOR ART

In the vertical continuous casting of steel bands it is known (EP 0 329 639 B1) to cool the strand which is cast with a parallelogram-like cross section in a revolving chill-mold while maintaining the cross section until a rigid shell which is already completely solidified is formed in the region of the longitudinal edges of the strand as a result of the parallelogram-like cross section before the strand is further cooled and is formed progressively with increasing solidification into a flat preliminary band and is compressed. The deformation of the strand which is cast with a parallelogram-like cross section into a plane-parallel preliminary band thus only occurs after the formation of a sufficiently thick shell. The transfer of the parallelogram-like cross section of the strand into a plane-parallel cross section occurs in a forming device which is composed of several longitudinal beams which are situated opposite of each other with respect to the band and which form between themselves a forming gap with a parallelogram-like inlet cross section and a plane-parallel outlet cross section, namely with the help of section rollers which are held in the longitudinal beams. Since the longitudinal beams are held in a swivelable fashion on the inlet side and are subjected to pressurization within the terms of mutual pivoting, one obtains—under the precondition of an even cooling—a thickness for the preliminary band completely solidified in the region of the forming device when the shells are pressed against each other, which thickness depends on the pass-through speed of the strand through the chill-mold and the forming device. The extent of the solidification determining the band thickness depends on the cooling duration which is a function of the pass-through speed of the band through the chill-mold and the forming device. This means that it is necessary to ensure a constant casting speed for a uniform, even band thickness.

In view of the cooperation with an upstream steel works and the possible direct further processing of the preliminary band in a subsequent rolling mill, a constant casting speed has operational disadvantages because circumstances can occur both in the steel works as well as the rolling mill which require a change in the casting speed or the casting output.

Apart from that, temperature fluctuations in the steel melt must be expected, which also entails fluctuations in the thickness of the preliminary band.

In order to simplify the reduction in thickness of continuously cast steel bands it is known (DE 41 35 214 A1) to carry out a rolling deformation of the cast strand before the liquid core is completely solidified. Said rolling deformation requires a shell which is already solidified in sufficient thickness, but which is compressed under crushing of the liquid core by the rollers without upsetting deformation, but is upset in the edge region. Said upsetting deformation on the edge is inevitably linked to an extension or lateral bulging, leading to wavy edges of the cast and thus reduced steel band or to tensions and a likelihood of cracks in the edge region. Nothing is changed in respect to this by a deformation-free guidance of the band between guide rollers with a constant gap, which guidance is provided subsequently to the reduction of the thickness and is provided for the complete solidification of the core.

SUMMARY OF THE INVENTION

The invention is thus based on the object of avoiding these disadvantages and to provide a method of the kind mentioned above in such away that despite any occurring changes concerning the casting speed and the temperature of the liquid steel it is possible to ensure a constant band thickness without any likelihood of wavy edges or formation of cracks.

This object is achieved by the invention in such a way that after the compression into a band the strand with a still liquid core is guided during the complete solidification of the core merely in a forming gap with a constant width corresponding to the thickness of the completely solidified longitudinal edges and is calibrated in this process.

Since for the purpose of the calibration of the band the bringing together of the shells is ended before the mutually opposite shells touch each other and the thickness of the forming gap is kept constant during the complete solidification of the thus remaining liquid core depending on the cooling-induced shrinkages, the definite band thickness is determined by the dimensions of the forming gap and not by the casting speed. The ferrostatic pressure acting in the region of the remaining liquid core ensures that the shells rest on the forming elements predetermining the geometry of the gap. Different thicknesses of the liquid core arising from different casting speeds can therefore not lead to any different band thicknesses as long as it is ensured that the core solidifies completely in the region of the constant thickness of the forming gap. The relevant aspect is that in the edge region no upsetting deformation of the band can occur in connection with an extension. This is ensured in such a way that the forming gap has a width corresponding to the thickness of the completely solidified longitudinal edges. Since the shell of the strand is transferred after the casting in a revolving chill-mold in a forming device from a parallelogram-like cross section to a plane-parallel cross section without upsetting the completely solidified longitudinal edges of the shell, said completely solidified longitudinal edges of the parallelogram-like cross section also determine the later thickness of the completely solidified band, so that there is no upsetting deformation of the longitudinal edge linked to an extension before the band is fully completely solidified.

Due to the complete solidification of the core without a stretching effect on the band, a cast structure can substantially be expected. After the complete solidification of the band the thickness of the band can be reduced slightly by simultaneous stretching preferably by means of force- and path-controlled rollers, leading to a respective improvement in the structure.

In order to enable the supply with especially thin preliminary bands for further processing in a rolling mill, the completely solidified band can be additionally reduced in its thickness by continuous rolling after the calibration, thus considerably reducing the amount of rolling work in the rolling mill.

For the purpose of performing the calibration in accordance with the invention of the continuously cast steel band it is possible to assume a continuous casting plant which consists of a chill-mold revolving together with the strand to be cast and having a forming gap cross section in the shape of a parallelogram, and of a downstream forming device with several rollers which are opposite of each other with respect to the strand and form between themselves a forming gap with a parallelogram-like inlet cross section and a plane-parallel outlet cross section. It needs to be ensured that a calibration device with a predetermined forming gap progress is provided adjacent to the forming device, which gap progress comprises a section with constant forming gap thickness at least on the inlet side, so that the complete solidification of the band occurs in the section of the forming gap with constant thickness. Depending on the casting speed the point of complete solidification of the band will occur along the forming gap. In the case of reduced casting speed, it is therefore possible to expect the complete solidification of the band in an initial section (i.e. in the upper region) and at an increased casting speed in an end section, i.e. in the lower region of the forming gap of the calibrating device.

Advantageous conditions are obtained when the calibrating device comprises calibrating rollers which delimit the forming gap and can be advanced to set the progress of the forming gap. Not only the thickness of the band can be determined in an advantageous fashion during its complete solidification between the calibrating rollers, but also an advance can be achieved when said calibrating rollers are driven. Due to the progressed solidification of the band it is not necessary to provide a continuous band guidance, so that cooling liquid can be applied to the band between the calibrating rollers.

After the solidification of the liquid residual core it is possible to perform a reduction in the thickness via the remaining calibrating rollers on the outlet side, e.g. in the magnitude of 1 to 5%, for the purpose of improving the structure, requiring a respectively preset progress of the forming gap.

The calibrating device can also reach far into the casting arc, allowing a reduction of the overall height.

In order to achieve an additional higher reduction in the thickness of the band, a reducing frame can be provided on the outlet side of the calibrating device which can be used to supply comparatively thin preliminary bands to a connected rolling mill.

BRIEF DESCRIPTION OF THE DRAWINGS

The method in accordance with the invention is explained below in closer detail by reference to the enclosed drawings, wherein.

DESCRIPTION OF THE PREFERRED EMBODIMENT

Figure 1:
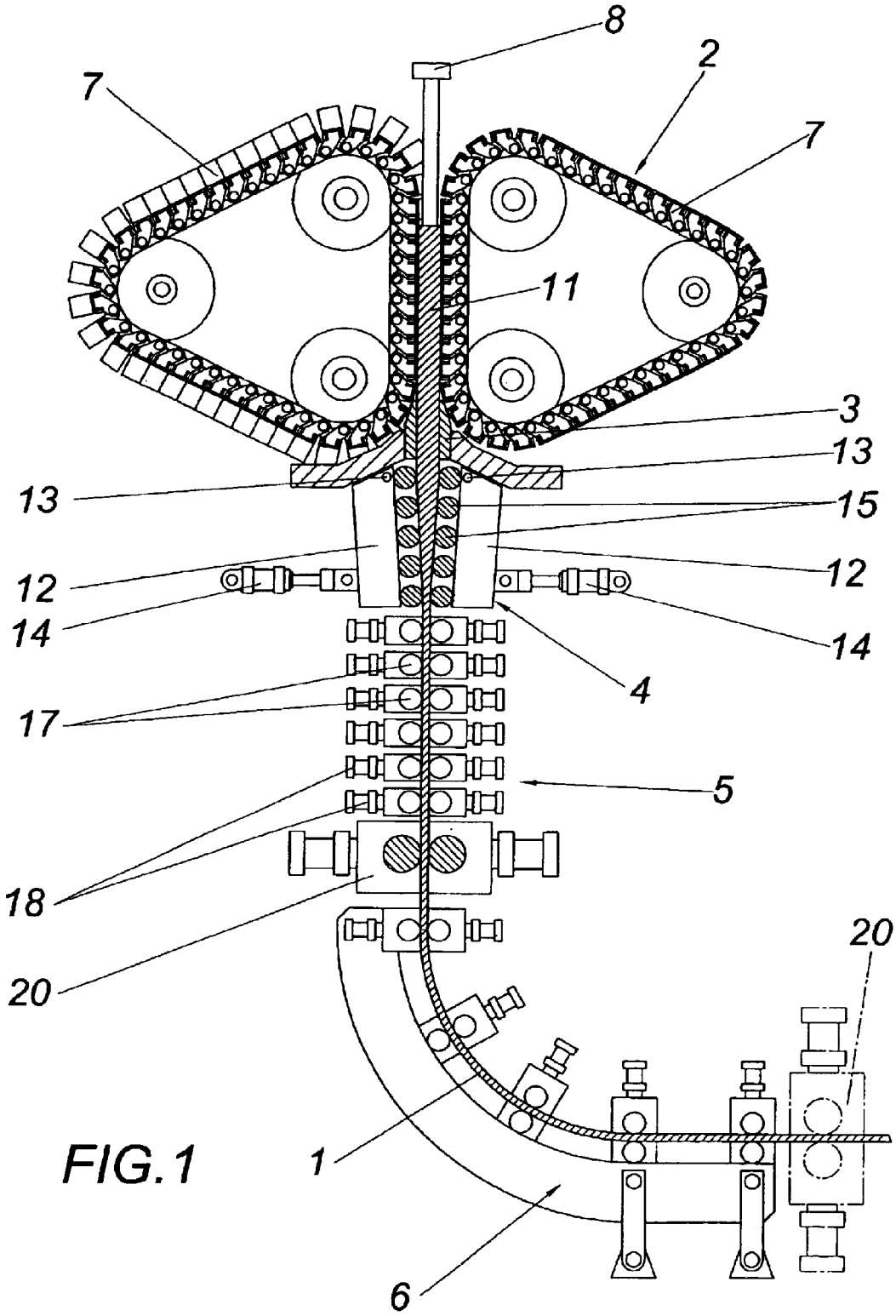
FIG. 1 shows in a schematic longitudinal view a continuous casting plant in accordance with the invention for continuous casting.

According to FIG. 1, the illustrated continuous casting plant for the vertical continuous casting of a steel band 1 comprises a revolving chill-mold 2, a forming device 4 which is adjacent thereto via a strand guidance means 3, and a calibrating device 5 from which the band 1 emerges in a casting arc 6 in order to be deflected by a vertical to a horizontal progress. The calibrating device 5 can extend at least partly into the region of the casting arc 6, allowing for a lower overall height.

Figure 3:
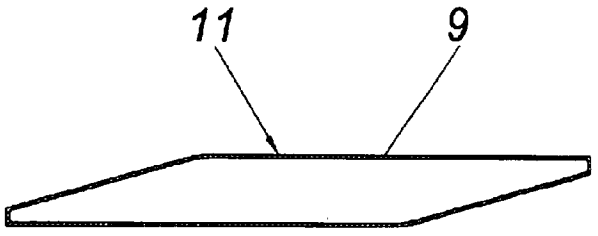
FIGS. 3 to 5 show the relevant changes in cross section of a strand cast according to the state of the art during its deformation into a band.
Figure 4:
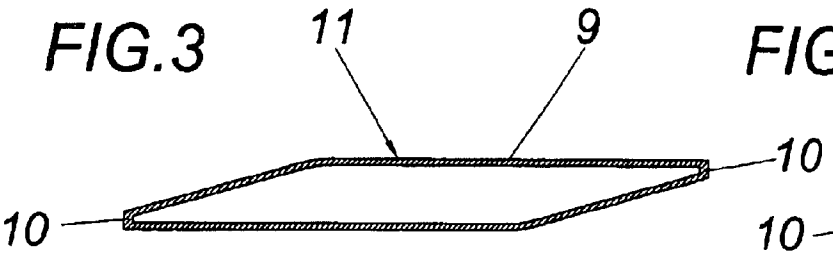

The revolving chill-mold 2 consists of two mutually opposite, continuously revolving plate chains 7 which enclose a constant forming gap between themselves and into which opens a casting pipe 8 attached to a casting container. The plates of the plate chain 7 which are mutually associated in pairs form a forming gap with a parallelogram-like cross section, so that the liquid steel cast into the forming gap of the revolving chill-mold 2 through the casting pipe 8 is chilled in the region of the plate chains 7 and, with progressing chilling, forms an increasingly thicker solidified shell 8 which is completely solidified in the region of the longitudinal edges 10 as a result of the strand thickness decreasing towards the longitudinal edges 10, as is shown in FIGS. 3 and 4 as well as 6 and 7 which show the strand 11 at first in the region of the revolving chill-mold 2 with a still thin shell 9 and then with an increasing shell thickness. As a result of the completely solidified longitudinal edges 10, a further guidance of the cast strand 11 via the strand guidance means 3 to the forming device 4 is easily possible, the forming gap of which gradually changes from the parallelogram-like inlet cross section to a plane-parallel outlet cross section. For this purpose the forming device 4 comprises several longitudinal beams 12 which are mutually opposite relative to the strand 11, form a forming gap between themselves, are held swivelable on the inlet side about axes 13 and are pressurized via a pressure cylinders 14 within the terms of a mutual swiveling. The forming gap is delimited by section rollers 15.

Figure 5:
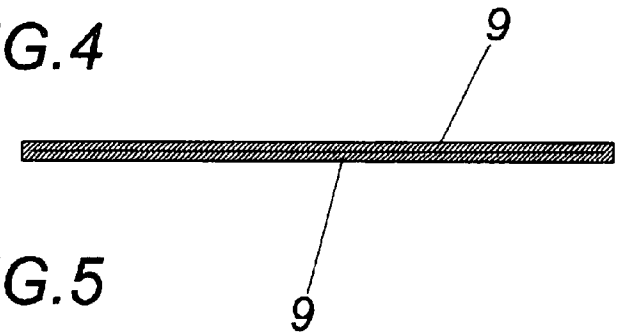
Figure 6:
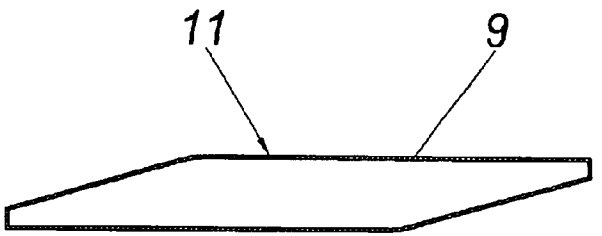
FIGS. 6 to 9 show a representation corresponding to FIGS. 3 to 5 of the changes in cross section of a strand case in accordance with the invention during its deformation into a band.
Figure 7:
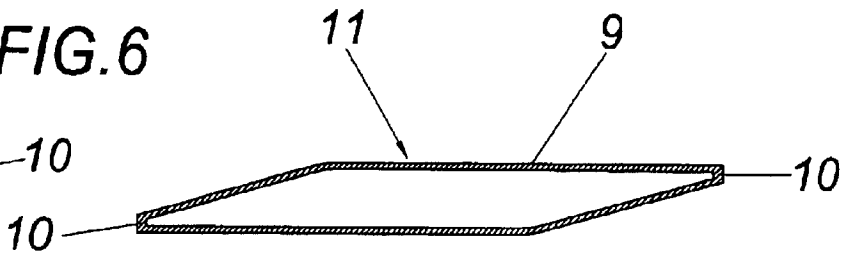
Figure 8:
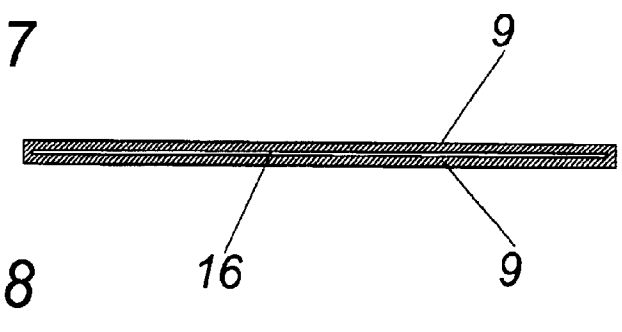
Figure 9:
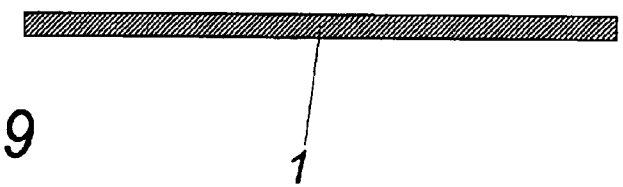

As is shown in FIG. 5, the shells 9 are guided in this forming device 4 upwardly against each other under displacement of the liquid core in accordance with the state of the art until they are pressed against each other and form a completely solidified band whose thickness depends on the casing speed or the temperature of the steel melt under constant chilling conditions. In contrast thereto, the shells 9 are led together in the forming device 4 only into a plane-parallel cross section with a still liquid core 16, as is shown in FIG. 8. Notice must be taken that the longitudinal edges 10 are not subjected to any upsetting deformation linked to the extension. The complete solidification of the liquid core 16 only occurs in the calibrating device 5 which at least on the inlet side has a forming gap of constant thickness, in the region of which the liquid core 16 solidifies completely until a band 1 of constant thickness is obtained according to FIG. 9. In this connection it needs to be considered that as a result of the ferrostatic pressure in the region of the liquid core 16 the shells 9 are pressed against the calibrating device 5, so that the predetermined forming gap width determines the band thickness irrespective of the casting speed or the thickness of the liquid core 16. The forming gap width needs to be chosen according to the thickness of the completely solidified longitudinal edges 10, so that any extension of the band 1 on the edge side is prevented.

The cooling, the pass-through speed of the strand 11 through the revolving chill-mold 2 and the forming device 4 as well as the length of the chill-mold 2 and the forming device 4 are adjusted to each other in such a way that the strand 11 still has a liquid core 16 on emerging from the forming device 4, because the complete solidification of the band 1 should only occur in the calibrating device 5. The calibrating rollers 17 of the calibrating device 5 are set via actuating cylinders 18 to a forming gap progress predetermined for the calibrating process. Since a considerable ferrostatic pressure prevails in the region of the liquid core 16, the shells 9 of the band 1 are pressed outwardly against the calibrating rollers 17 in the region of the calibrating device 5, thus ensuring the desired calibrating effect. The respective thickness of the liquid core 16 can vary upon the entrance of the band 1 into the calibrating device 5.

Figure 2:
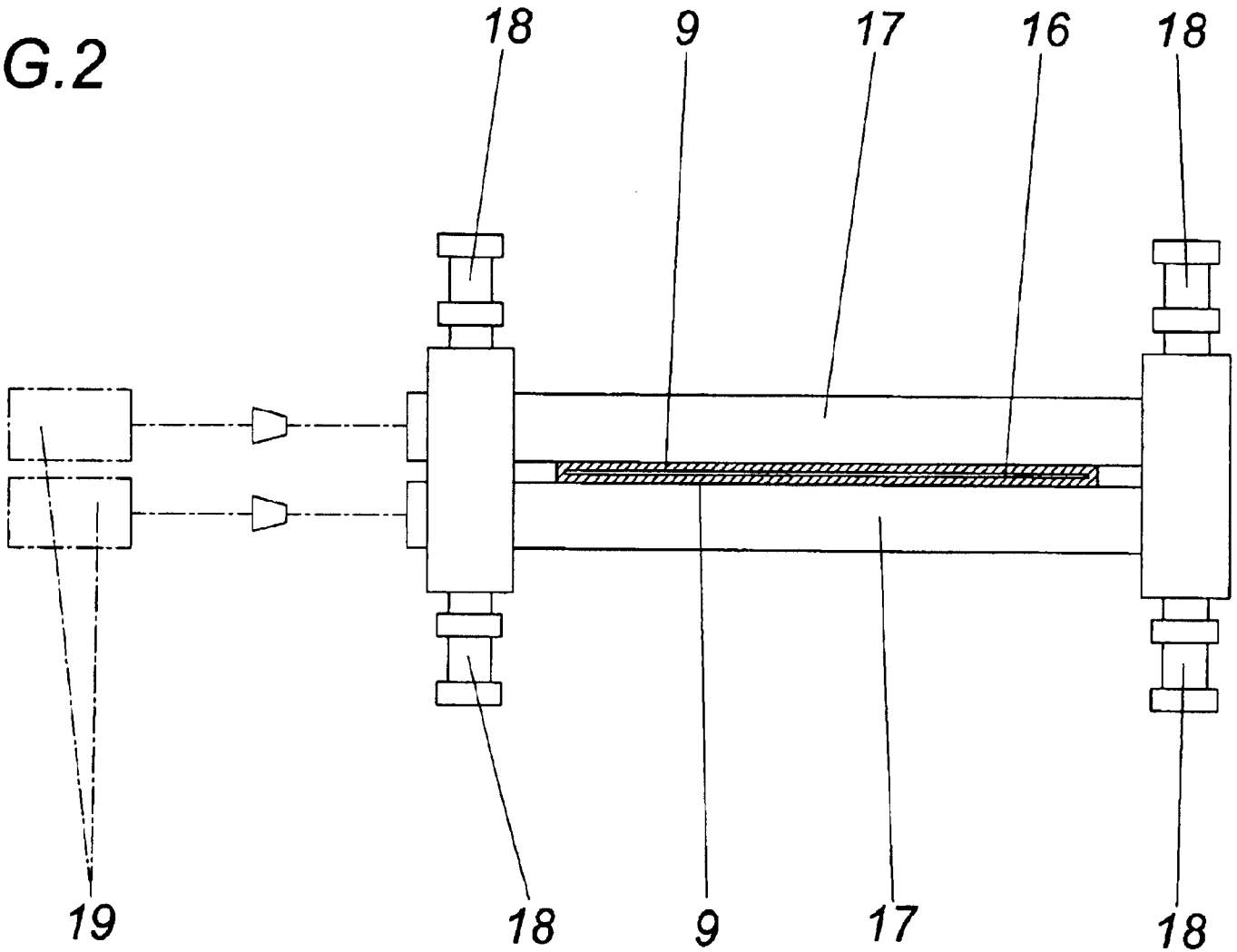
FIG. 2 shows a simplified cross-sectional view of the calibrating device on an enlarged scale.

Since a plane-parallel band cross section is already assumed in the calibrating device 5, the calibrating rollers 17 run through over the band width, as is shown in FIG. 2. The schematically indicated drive 19 of the calibrating rollers 17 supports band conveyance and is also suitable for a low rolling output following the complete solidification of the liquid core 16, so that after the complete solidification of the band 1 the calibrating rollers 17 can be used for a slight reduction in the thickness under a stretching effect. In order to enable the performance of stronger reductions in thickness, the calibrating device 5 can be provided downstream with a rolling frame 20. Said rolling frame 20 can also be provided after the casting arc 6, as is indicated with the dot-dash line in FIG. 1.

What is claimed is:

1. A method for the continuous vertical casting of a steel band, which comprises the steps of (a) first casting a strand of a parallelogram-shaped cross section in a casting direction in a revolving chill-mold which progressively cools the strand to form a band comprised of an increasingly thicker solidified shell having completely solidified edges and a liquid core, (b) then passing the band into a forming device changing from a parallelogram-shaped inlet cross section to a plane-parallel outlet cross section, (c) progressively compressing the band in the casting direction in the forming device without subjecting the completely solidified longitudinal edges to compressive strain, and (d) finally guiding the compressed band still containing the liquid core into a forming gap of a constant width corresponding to the thickness of the completely solidified longitudinal edges, the liquid core being completely solidified in the forming gap as the band is being calibrated.

2. The method of claim 1, wherein the band is stretched to reduce the thickness thereof immediately after the liquid has been completely solidified.

3. The method of claim 1, wherein the thickness of the band is reduced by rollers after it has been calibrated.

4. A continuous casting plant for the continuous vertical casting of a steel band, which comprises (a) a revolving chill-mold having a forming gap of a parallelogram-shaped cross section in a casting direction for casting and progressively cooling a strand to form a band comprised of an increasingly thicker solidified shell having completely solidified edges and a liquid core, (b) a forming device changing from a parallelogram-shaped inlet cross section to a plane-parallel outlet cross section, the forming device being arranged to receive the band from the revolving chill-mold, the forming device (1) progressively compressing the band in the casting direction without subjecting the completely solidified longitudinal edges to compressive strain, and (c) a forming gap being arranged to receive the compressed band still containing the liquid core, the forming gap having a constant width corresponding to the thickness of the completely solidified longitudinal edges to calibrate the band, the liquid core being completely solidified in the forming gap as the band is being calibrated.

5. The continuous casting plant of claim 4, comprising calibrating rollers arranged in the forming qap, the calibrating rollers being adjustable for setting the dimension of the forming gap.

6. The continuous casting plant of claim 4, comprising a terminal casting arc, the forming gap extending into the casting arc.

7. The continuous casting plant of claim 4, comprising a rolling frame at an outlet end of the plant.

* * * * *